US007735823B2

(12) United States Patent
Ito et al.

(10) Patent No.: US 7,735,823 B2
(45) Date of Patent: Jun. 15, 2010

(54) SHEET-FEEDING CASSETTE AND IMAGE FORMING APPARATUS

(75) Inventors: Yoshiyuki Ito, Nagoya (JP); Makoto Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 426 days.

(21) Appl. No.: 11/288,384

(22) Filed: Nov. 29, 2005

(65) Prior Publication Data

US 2006/0113724 A1 Jun. 1, 2006

(30) Foreign Application Priority Data

Nov. 30, 2004 (JP) ..... 2004-347646

(51) Int. Cl.
*B65H 1/00* (2006.01)

(52) U.S. Cl. ..... 271/171; 271/162

(58) Field of Classification Search ..... 271/171, 271/162

See application file for complete search history.

(56) References Cited

U.S. PATENT DOCUMENTS

| | | | | |
|---|---|---|---|---|
| 4,569,587 | A * | 2/1986 | Miyoshi et al. | 355/72 |
| 4,786,044 | A * | 11/1988 | Moody | 271/171 |
| 5,172,903 | A * | 12/1992 | Haneda et al. | 271/171 |
| 5,188,351 | A * | 2/1993 | Gysling | 271/171 |
| 5,537,195 | A | 7/1996 | Sagara et al. | |
| 5,611,528 | A * | 3/1997 | Nakamura et al. | 271/164 |
| 5,815,787 | A * | 9/1998 | Crayton et al. | 399/393 |
| 6,039,315 | A * | 3/2000 | Lim | 271/160 |
| 6,182,963 | B1 * | 2/2001 | Yergenson | 271/160 |
| 6,435,499 | B1 * | 8/2002 | Tomatsu | 271/147 |
| 2002/0080426 | A1 | 6/2002 | Ito | |
| 2004/0164479 | A1 * | 8/2004 | Shin | 271/171 |
| 2004/0188923 | A1 * | 9/2004 | Asada | 271/171 |

FOREIGN PATENT DOCUMENTS

| | | |
|---|---|---|
| JP | A 62-8923 | 1/1987 |
| JP | A 6-48591 | 2/1994 |
| JP | A 7-117864 | 5/1995 |
| JP | A-09-110184 | 4/1997 |
| JP | A-11-139572 | 5/1999 |
| JP | A 11-208900 | 8/1999 |
| JP | A 2002-145456 | 5/2002 |
| JP | A-2002-154668 | 5/2002 |

* cited by examiner

*Primary Examiner*—Patrick Mackey
*Assistant Examiner*—Howard Sanders
(74) *Attorney, Agent, or Firm*—Oliff & Berridge, PLC

(57) ABSTRACT

A sheet-feeding cassette includes: a first tray having a first wall section and a sheet-urging plate; and a second tray having a second wall section, the second tray being coupled to the first tray in a movable manner whereby an interval between the first wall section and the second wall section is changeable. A wall surface of the second wall section, which comes into contact with the sheet, comes to a position upstream of an upstream end portion of the first tray main body. A downstream end portion of the second tray in the sheet-feeding direction comes to a position downstream of an upstream end portion of the sheet-urging plate in the sheet-feeding direction.

16 Claims, 8 Drawing Sheets

SHEET-FEEDING CASSETTE AND IMAGE FORMING APPARATUS

CROSS REFERENCE TO RELATED APPLICATION

This application claims priority from Japanese Patent Application No. 2004-347646, filed on Nov. 30, 2004, the entire subject matter of which is incorporated herein by reference.

TECHNICAL FIELD

The present invention relates to a sheet-feeding cassette and an image forming apparatus.

BACKGROUND

In a known technique for a sheet-feeding cassette for use in an image forming apparatus, such as a laser printer, a sheet housing section is formed from two trays constituted of a first tray and a second tray, and the second tray can be disposed in a state of projecting from the first tray. For instance, a sheet-feeding cassette disclosed in JP-A-6-48591 is configured such that a sub-container 2 serving as the second tray is removably attached to a main container 1 serving as the first tray, and the sub-container 2 can be disposed in a state of projecting from the main container 1. By means of this configuration, a wall section (a rear wall 2*c*) which supports one end portion of a sheet can be disposed at a location further upstream of an upstream end portion of the main container 1 in the sheet-feeding direction. Thus, sheets of larger sizes can be housed.

SUMMARY

Meanwhile, the related-art sheet-feeding cassette, which can be extended, such as that disclosed in JP-A-6-48591, involves a problem that, when a sheet of a size smaller than a main container; e.g., a postcard size, is loaded so as to guide the sheet, a leading end of a sub-container interferes with an intermediate plate (a sheet-urging plate) which is disposed in the main container. Specifically, provision of some, type of coupling section for coupling a wall section of a sub-container and a main container is essential in such a configuration as employed in JP-A-6-48591 in which the wall section of a sub-container (a second tray) is disposed at a further upstream position of an upstream end portion in a sheet-feeding direction (hereinafter simply called "upstream end portion") of the main container (a first tray). However, such a configuration involves a problem that, since the coupling section tends to interfere with the pressing plate, the sub-container cannot be disposed in a position located far downstream.

Meanwhile, reducing the size of the pressing plate so as to accommodate sheets of smaller sizes is also conceivable. However, when the pressing plate is formed excessively small, positions of leading ends of sheets change to a large extent depending on the number of housed sheets, whereby maintaining the positions of the leading ends of the sheets invariant encounters difficulty. Thus, there arises a problem that stable sheet-feeding is hindered.

Meanwhile, as a technique for solving the above problem, such a configuration as disclosed in JP-A-2002-145456 is conceivable. According to the configuration described in JP-A-2002-145456, there is provided a guide section 15 of a small size which can be displaced independently from an extension tray 13, serving as a sub-container. When a sheet of a small size is to be housed, only the guide section 15 is displaced downstream in a sheet-feeding direction, thereby coping therewith. However, such a configuration involves a problem that both the extension tray and the guide section must be operated, whereby operation becomes complicated.

Aspects of the present invention provides a configuration in which: a sheet can be guided at a location further upstream of an upstream end portion of a first tray; sheets of smaller sizes can be guided; and, furthermore, operation of resizing a sheet housing section configured as described above can be performed readily.

According to an aspect of the present invention, there is provided a sheet-feeding cassette having a sheet housing section for housing a plurality of sheets, including: a first tray located on a downstream end portion of the sheet housing section in a sheet-feeding direction, the first tray including a first tray main body having a first wall section that regulates a position of the sheet in the sheet housing section by coming into contact with the sheet, and a sheet-urging plate being pivotably attached to the first tray main body and capable of urging a downstream end portion of the sheet; and a second tray located at an upstream end portion of the sheet housing section in the sheet-feeding direction, the second tray including a second tray main body having a second wall section that regulates the position of the sheet in the sheet housing section by coming into contact with the sheet, the second tray being coupled to the first tray in a movable manner whereby an interval between the first wall section and the second wall section is made changeable; wherein a wall surface of the second wall section, which comes into contact with the sheet, is movable to a position upstream of an upstream end portion of the first tray main body; and a downstream end portion of the second tray in the sheet-feeding direction is movable to a position downstream of an upstream end portion of the sheet-urging plate in the sheet-feeding direction.

According to the aspect, the wall surface of the second wall section, which contacts the sheets, is made movable so as to come to a position upstream of the upstream end portion of the first tray main body. Accordingly, sheets, which are so large as to extend beyond the first tray, can be housed in the sheet housing section. Moreover, since the pivotal axis of the sheet-urging plate is fastened to the first tray main body, a positional relationship between the sheet-urging plate and the first wall section is determined, and a downstream end portion of sheets guided by the first wall section can be stably pressed. Furthermore, the downstream end portion of the second tray is made movable to a position downstream of the upstream end portion of the sheet-urging plate. Therefore, the second tray can be placed at a further downstream position with reference to the sheet-feeding direction. Consequently, the interval between the first wall section and the second wall section can be set to a smaller value, and by extension, a configuration which can cope with sheets of smaller sizes is provided.

BRIEF DESCRIPTION OF THE DRAWINGS

Illustrative aspects of the invention may be more readily described with reference to the accompanying drawings.

DETAILED DESCRIPTION

An aspect of the present invention will now be described with reference to FIGS. 1 through 8.

1. Overall Configuration of the Embodiment

Figure 1:
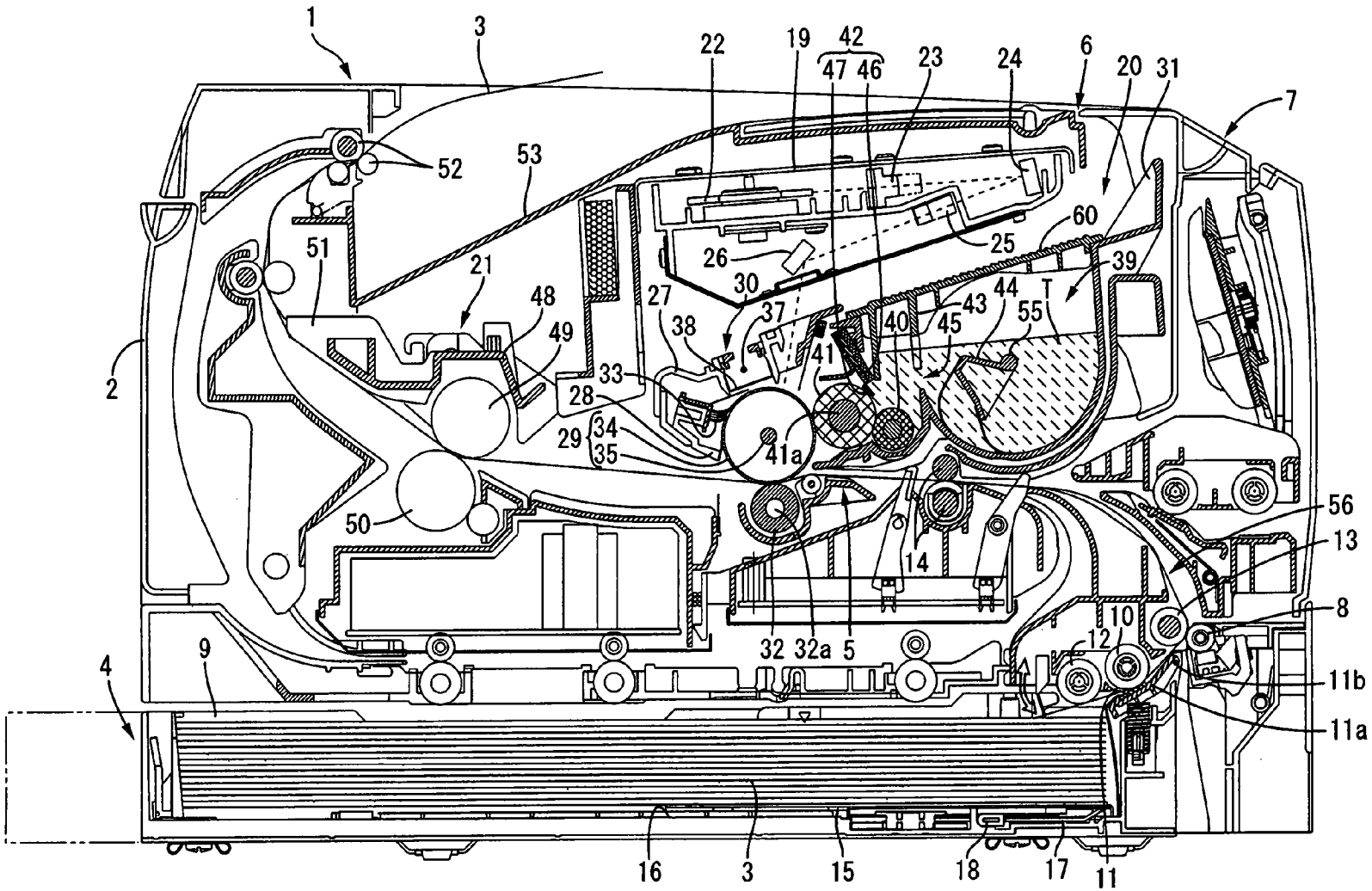
FIG. 1 is a cross-sectional view of a principal section, showing a laser printer according to an aspect of the present invention.

FIG. 1 is a side cross-sectional view of a principal section, showing a laser printer employed as an image forming apparatus. This laser printer 1 has a main body casing 2; a feeder-section 4 which is housed in the main body casing 2 and feeds sheets 3 employed as recording media; an image-forming section 5 for forming an image on the fed sheet 3; and the like.

(1) Main Body Casing

Figure 2:
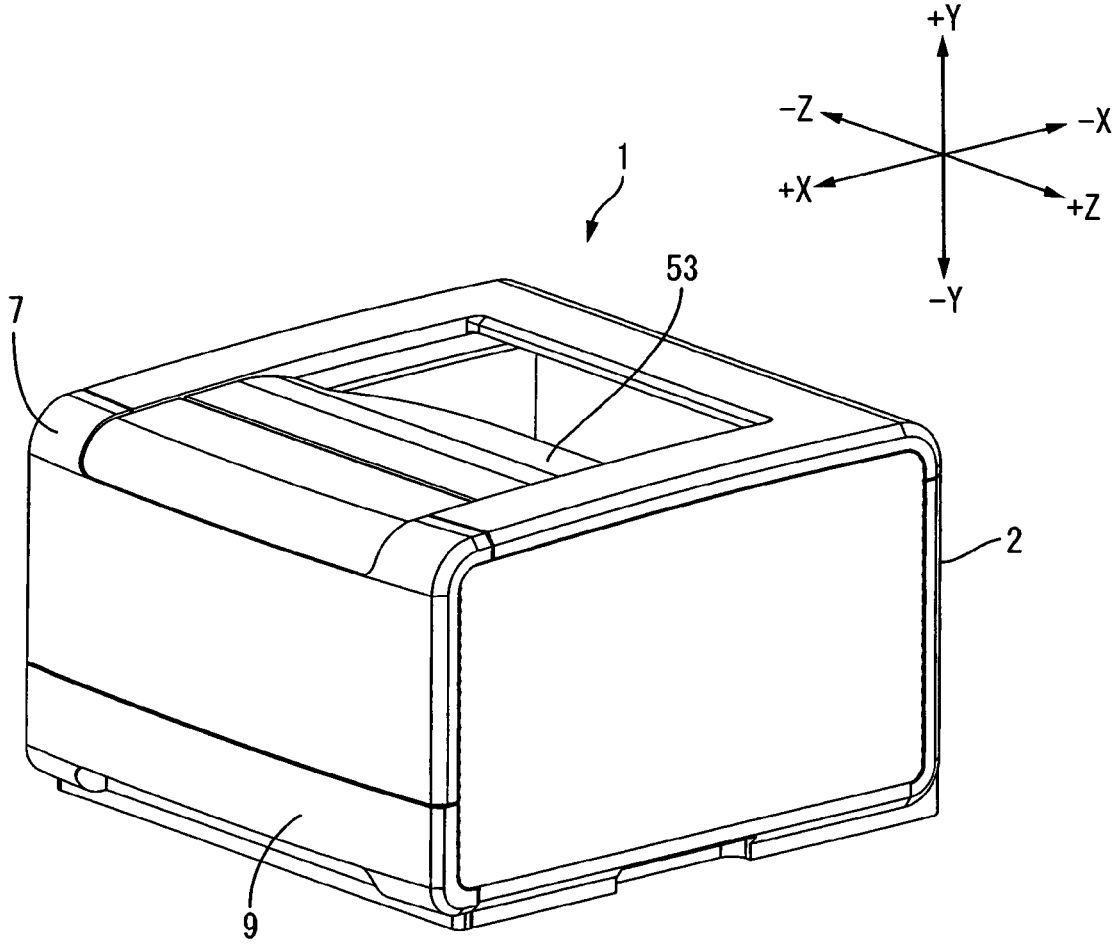
FIG. 2 is a perspective view of the laser printer shown in FIG. 1.

An attachment-detachment port 6 used for removing and attaching a process cartridge 20 to be described later is formed in one walls of the main body casing 2. As shown in FIGS. 1 and 2, a front cover 7 used for opening/closing the attachment-detachment port 6 is provided. The front cover 7 is supported so as to be pivotable about a cover shaft (not shown) inserted into a lower end of the front cover 7. As shown in FIG. 1, when the front cover 7 is pivoted about the cover shaft in a closing manner, the attachment-detachment port 6 is closed by the front cover 7. In contrast, when the front cover 7 is pivoted (tilted) in an opening manner while the cover shaft is taken as a fulcrum, the attachment-detachment port 6 is opened, so that the process cartridge 20 can be removably attached to the main body casing 2 by way of the attachment-detachment port 6.

In the following description, with the process cartridge 20 being attached to the main body casing 2, the part of the main body casing where the front cover 7 is provided (namely, the +X side with reference to the direction of an X axis in FIG. 2) is taken as a front side, whilst the other part of the same is taken as a rear side.

(2) Feeder Section

The feeder section 4 has a sheet-feeding cassette 9 removably attached to a bottom section within the main body casing 2; a separation roller 10 and a separation pad 11, which are provided at positions above a front end portion of the sheet-feeding cassette 9; and a sheet-feeding roller 12 provided on the rear of the separation roller 10 (at a position upstream of the separation pad 11 with respect to a transport direction of the sheet 3). The feeder section 4 also has a paper dust removal roller 8 disposed at a position above and forward of the separation roller 10 (a position downstream of the separation roller with respect to the transport direction of the sheet 3) so as to oppose the separation roller 10; and an opposing roller 13 disposed opposite the paper dust removal roller 8.

The transport path of the sheet 3 is folded rearward into the shape of the letter U from the neighborhood of the location where the paper dust removal roller 8 is disposed. A registration roller 14 consisting of a pair of rollers is provided at a position below the process cartridge 20 and further downstream of the folded area with respect to the transport direction.

A sheet-urging plate 15 which enables loading of the sheets 3 in a stacked manner is provided in the sheet-feeding cassette 9. A rear end portion of the sheet-urging plate 15 is supported in a swayable manner between a loading position (shown in FIG. 1) where a front end portion of the sheet-urging plate 15 is situated downward against a bottom plate 16 of the sheet-feeding cassette 9, and a feeding position (shown in FIGS. 4 and 6) where the front end portion is situated upward in an inclined manner.

A lever 17 used for lifting the front end portion of the sheet-urging plate 15 is provided at the front end portion of the sheet-feeding cassette 9. A rear end portion of this lever 17 is swayably supported by a lever shaft 18 at a position below the front end portion of the sheet-urging plate 15. The lever 17 is swayable between a face-down position (shown in FIG. 1) where the front end portion of the lever 17 faces downward against the bottom plate 16 of the sheet-feeding cassette 9, and an inclined position (omitted from the drawing) where the front end portion of the lever 17 lifts the sheet-urging plate 15. When rotational driving force, which is counterclockwise in the drawing, is input to the lever shaft 18, the lever 17 rotates while taking the lever shaft 18 as a fulcrum, whereby the front end portion of the lever 17 lifts the front end portion of the sheet-urging plate 15, thereby moving the sheet-urging plate 15 to the feeding position.

When the sheet-urging plate 15 has come to the feeding position, the sheets 3 on the sheet-urging plate 15 are pressed against the sheet-feeding roller 12. By means of rotation of the sheet-feeding roller 12, feeding of a sheet toward a separation position between the separation roller 10 and the separation pad 11 is initiated.

Meanwhile, when the sheet-feeding cassette 9 is detached from the main body casing 2, the front end portion of the sheet-urging plate 15 moves downward under its own weight, whereupon the sheet-urging plate 15 comes to the loading position. When the sheet-urging plate 15 has come to the loading position, the sheets 3 can be loaded on the sheet-urging plate 15 in a stacked manner. The separation pad 11, the paper dust removal roller 8, the sheet-urging plate 15, and the lever 17 are provided on the sheet-feeding cassette 9. The sheet-feeding roller 12, the separation roller 10, the opposing roller 13, and the registration roller 14 are provided on the main body casing 2.

When being nipped between the separation roller 10 and the separation pad 11, the sheets 3 sent toward the separation position by the sheet-feeding roller 12 are separately fed one sheet at a time by means of rotation of the separation roller 10. The thus-fed sheet 3 is turned back along the U-shaped transport path 56. More specifically, the fed sheet 3 is first transported upward while passing between the separation roller 10 and the separation pad 11. Further, the sheet 3 is subjected to removal of paper dust while passing between the paper dust removal roller 8 and the opposing roller 13, and is then transported to the registration roller 14.

After having registered the sheet 3, the registration roller 14 transports the sheet 3 to a transfer position between a photosensitive drum 29 and a transfer roller 32, which will be described later, where a toner image on the photosensitive drum 29 is transferred to the sheet 3.

(3) Image-Forming Section

The image-forming section 5 has a scanner section 19, the process cartridge 20, a fixing section 21, and the like.

(a) Scanner Section

The scanner section 19 is disposed at a higher position within the main body casing 2, and includes an unillustrated laser light source, a polygon mirror 22 which is rotationally driven, an fθ lens 23, a reflection mirror 24, a lens 25, a reflection mirror 26, and the like. The laser beam that has been emitted from a laser light source in accordance with image data is deflected by the polygon mirror 22 as indicated by a chain line. After the laser beam has passed through the fθ lens 23, an optical path of the laser beam is turned back by the reflection mirror 24. After the laser beam has further passed through the lens 25, the optical path of the laser beam is further bent downward by the reflection mirror 26, to thus irradiate the surface of the photosensitive drum 29, which will be described later, of the process cartridge 20.

(b) Process Cartridge

The process cartridge 20 is removably attached to the main body casing 2 at a position below the scanner section 19. The process cartridge 20 has, as an enclosure, an upper frame 27, and a lower frame 28, which is formed separately from the upper frame 27 and is to be combined with the upper frame 27. The process cartridge 20 has, in the enclosure, the photosensitive drum 29 serving as an image carrier, a scorotron charger 30, a development cartridge 31, the transfer roller 32, and a cleaning brush 33.

The photosensitive drum 29 has a drum main body 34 which assumes a cylindrical shape and whose outermost layer is formed from a photosensitive layer which is for positive electrification, and which is made from polycarbonate, or the like; and a metal drum shaft 35 serving as a shaft extending along the longitudinal axis of the drum main body 34. The drum shaft 35 is supported by the upper frame 27, and the drum main body 34 is supported so as to be rotatable about the drum shaft 35, whereby the photosensitive drum 29 is provided on the upper frame 27 so as to be rotatable about the drum shaft 35.

The scorotron charger 30 is supported by the upper frame 27, and is disposed at an upwardly rearward oblique position in relation to the photosensitive drum 29 so as to oppose the photosensitive drum 29 with a predetermined distance therefrom so as not to come into contact therewith. This scorotron charger 30 has a discharge wire 37 disposed opposite the photosensitive drum 29 with a predetermined interval therebetween; and a grid 38 which is interposed between the discharge wire 37 and the photosensitive drum 29 and which controls the level of electric discharge from the discharge wire 37 to the photosensitive drum 29. The scorotron charger 30 applies a high voltage to the discharge wire 37 simultaneously with application of a bias voltage to the grid 38, to thus cause the discharge wire 37 to effect corona discharge. Thus, the surface of the photosensitive drum 29 can be positively charged in a uniform manner.

The development cartridge 31 has a box-shaped housing case 60 whose rear portion is open, and is removably attached to the lower frame 28. A toner storage chamber 39, a toner-feeding roller 40, a development roller 41, and a layer thickness regulatory blade 42 are provided within the development cartridge 31.

The toner storage chamber 39 is formed as a front internal space of the housing case 60 partitioned by a partition plate 43. The toner storage chamber 39 is filled with nonmagnetic, mono-component toner T to be positively charged and serving as a developing agent. Polymer toner to be used as the toner T is obtained through copolymerization, by suspension polymerization, or the like, of polymeric monomers, such as: styrene-based monomers, such as styrene; and acrylic monomers, such as acrylic acids, alkyl (C1 to C4) acrylates, and alkyl (C1 to C4) meta-acrylates. This polymer toner assumes an essentially-spherical shape, exhibits extremely superior fluidity, and enables formation of a high-quality image.

Meanwhile, the toner is formulated with a coloring agent, such as carbon black, and wax, and an external additive, such as silica, is also added with a view toward enhancing fluidity. The average particle size of the toner is about 6 to 10 μm.

An agitator 44 supported by a rotary shaft 55 disposed in the center of the toner storage chamber 39 is provided in the toner storage chamber 39. This agitator 44 is rotationally driven by an input of power from an unillustrated motor. When the agitator 44 is rotationally driven, the toner T in the toner storage chamber 39 is stirred and discharged toward the toner-feeding roller 40 by way of an opening section 45 which is formed in a lower portion of the partition plate 43 to thus form a longitudinal passage. A window member (not shown) is attached to each of areas on both sidewalls of the housing case 60, wherein the areas respectively correspond to the toner storage chamber 39. The respective window members are cleaned by wipers which are held by the agitator 44 and actuated synchronously. In the main body casing 2, a light-emitting element (not shown) is provided outside of one window member, and a light-receiving element (not shown) is provided outside of the other window member. Detection light that has been emitted from the light-emitting element and passed through the inside of the housing case 60 is detected by the light-receiving element, and presence/absence of the toner T is determined in accordance with an output value from the light-receiving element.

The toner-feeding roller 40 is disposed rearward of the opening section 45, and is supported by the development cartridge 31 in a rotatable manner. The toner-feeding roller 40 is formed by covering a metal roller shaft with a roller made of a conductive, foamed material. This toner-feeding roller 40 is rotationally driven by an input of power from an unillustrated motor.

The development roller 41 is located rearward of the toner-feeding roller 40 and rotatably supported by the development cartridge 31 while remaining in mutually-compressed contact with the toner-feeding roller 40. The development roller 41 opposes and contacts the photosensitive drum 29 while the development cartridge 31 remains attached to the lower frame 28. The development roller 41 is formed by covering a metal roller shaft 41a with a roller formed from a conductive, rubber material. Both ends of the roller shaft 41a protrude outward from side surfaces of the development cartridge 31 at the rear end portion thereof, in a widthwise direction orthogonal to the longitudinal direction. The roller of the development roller 41 is formed by means of coating the surface of a roller main body formed from conductive urethane rubber or silicone rubber containing fine carbon particles, or the like, with a coating layer formed from urethane rubber or silicon rubber containing fluorine. During development operation, a development bias is applied to the development roller 41. By means of an input of power from the unillustrated motor, the development roller 41 is rotationally driven in the same direction as is the toner-feeding roller 40.

The layer thickness regulatory blade 42 has a pressing section 47 which is provided at the extremity of a blade main body 46 formed from a metal leaf spring member and is formed from insulating silicon rubber; and which assumes a semicircular cross-sectional profile. This layer thickness regulatory blade 42 is supported by the development cartridge 31 at a position above the development roller 41, and the pressing section 47 is compressed onto the development roller 41 by means of elastic force of the blade main body 46.

The toner T discharged out of the opening section 45 is fed to the development roller 41 by means of rotation of the toner-feeding roller 40. At this time, the toner is positively charged through friction between the toner-feeding roller 40 and the development roller 41. The toner T fed over the development roller 41 enters between the pressing section 47 of the layer thickness regulatory blade 42 and the development roller 41 in association with rotation of the development roller 41, and is carried over the development roller 41 as a thin layer of a given thickness.

The transfer roller 32 is rotationally supported by the lower frame 28. In a state where the upper frame 27 and the lower frame 28 are combined together, the transfer roller 32 is arranged so as to oppose and contact the photosensitive drum 29 in the vertical direction, to thus form a nip between the photosensitive drum 29 and the transfer roller 32. The transfer roller 32 is formed by covering a metal roller shaft 32*a* with a roller made of a conductive rubber material. During transfer operation, a transfer bias is applied to the transfer roller 32. The transfer roller 32 is rotationally driven in a direction opposite that of the photosensitive drum 29 by means of an input of power from the unillustrated motor.

The cleaning brush 33 is attached to the lower frame 28. In the state where the upper frame 27 and the lower frame 28 are combined together, the cleaning brush 33 is arranged so as to oppose and contact the photosensitive drum 29 at a position rearward thereof.

In association with rotation of the photosensitive drum 29, the surface of the photosensitive drum 29 is first uniformly, positively charged by the scorotron charger 30. Subsequently, the surface is exposed to high-speed scanning by the laser beam output from the scanner section 19, thereby forming an electrostatic latent image corresponding to the image to be formed-on the sheet 3.

Next, when the positively-charged toner carried on the development roller 41 opposes and contacts the photosensitive drum 29 by means of rotation of the development roller 41, the toner is fed to the electrostatic latent image formed on the surface of the photosensitive drum 29; namely, the toner is fed to exposed areas—on the uniformly, positively-charged surface of the photosensitive drum 29—where electric potentials are reduced upon exposure to the laser beam. As a result, the electrostatic latent image of the photosensitive drum 29 is visualized, and a toner image formed through reversal development is carried on the surface of the photosensitive drum 29.

As shown in FIG. 1, the toner image carried on the surface of the photosensitive drum 29 is transferred to the sheet 3 by means of the transfer bias applied to the transfer roller 32 within a period during which the sheet 3 transported by the registration roller 14 passes through the transfer position between the photosensitive drum 29 and the transfer roller 32. The sheet 3, on which the toner image is transferred, is transported to the fixing section 21.

Transfer residual toner still remaining on the photosensitive drum 29 after transfer operation is recovered by the development roller 41. Moreover, the paper dust which has originated from the sheet 3 and is still adhering to the photosensitive drum 29 after transfer operation is recovered by the cleaning brush 33.

(c) Fixing Section

The fixing section 21 is provided rearward of the process cartridge 20 and has a fixing frame 48, and a heating roller 49 and a pressure roller 50, both of which are provided within the fixing frame 48.

The heating roller 49 has a metal pipe whose surface is coated with fluororesin, and a halogen lamp for heating purpose incorporated in the metal pipe. The heating roller 49 is rotationally driven by an input of power from the unillustrated motor. Meanwhile, the pressure roller 50 is disposed at a position below the heating roller 49 so as to oppose and press the heating roller 49. The pressure roller 50 is formed by means of coating a metal roller shaft with a roller made of a rubber material, and is driven in accordance with rotational driving action of the heating roller 49.

The toner transferred on the sheet 3 at the transfer position is thermally fixed by the fixing section 21 during the course of the sheet 3 passing between the heating roller 49 and the pressure roller 50. The sheet 3 having the toner fused thereon is transported to a sheet output path 51 which extends vertically toward the upper surface of the main body casing 2. The sheet 3 transported to the sheet output path 51 is output to a sheet output tray 53 formed in the upper surface of the main body casing 2, by means of a sheet output roller 52 disposed at a position above the paper output path 51.

2. Sheet-Feeding Cassette

Next, the sheet-feeding cassette will now be described with reference to FIGS. 3 through 8.

Figure 3:
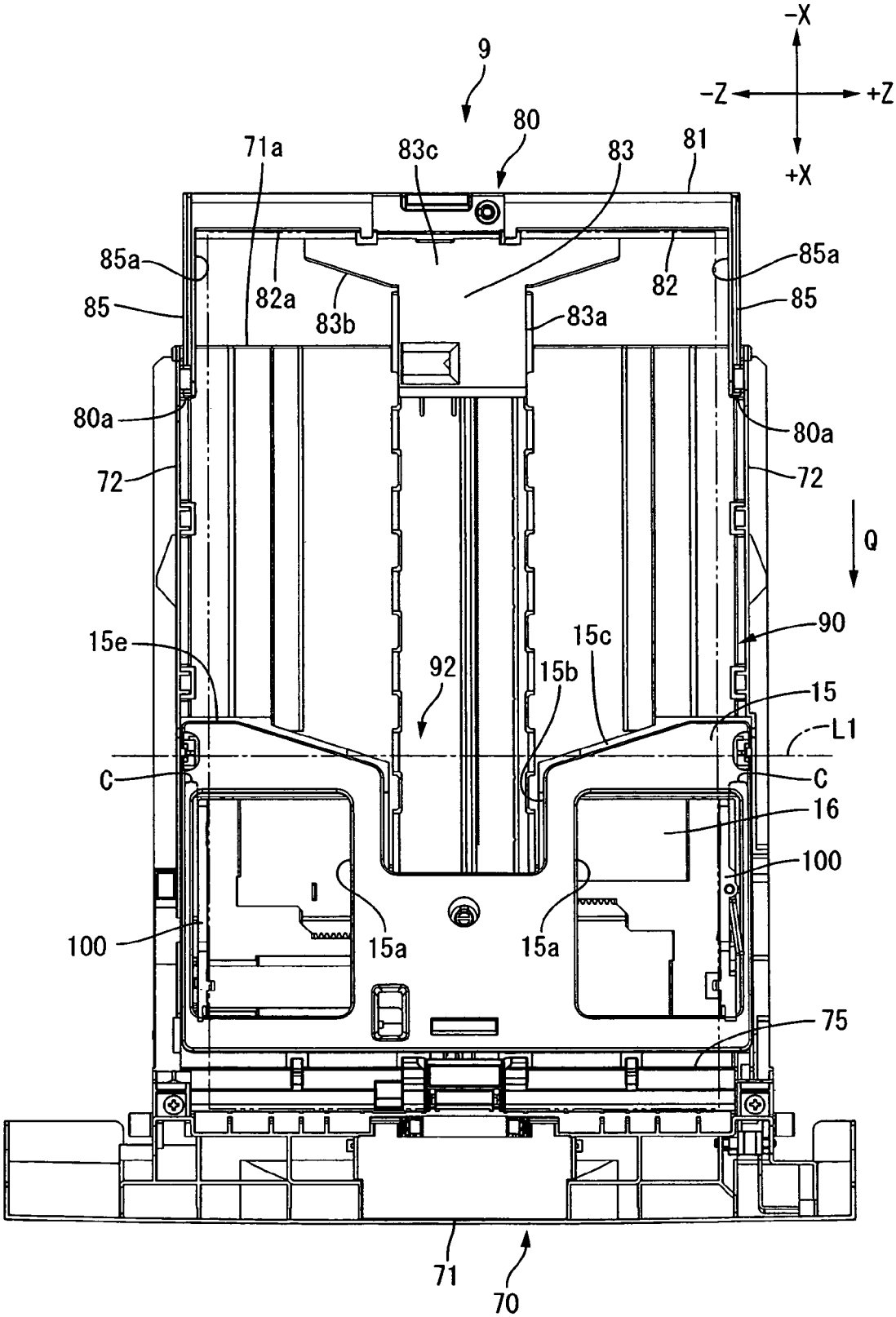
FIG. 3 is a plan view illustrating a size-enlarged state of a sheet-feeding cassette of the aspect.

As shown in FIG. 3, the sheet-feeding cassette 9 has a sheet housing section 90 where the plurality of sheets 3 are housed, and is configured such that the housed sheets 3 are separated and fed one at a time. The sheet-feeding cassette 9 has a first tray 70 and a second tray 80. The sheet housing section 90 is formed from the first tray 70 and the second tray 80.

In the first tray 70, a first wall section 75 is provided on the downstream end portion of the sheet housing section 90 in the sheet-feeding direction of the sheet 3 (in the direction of arrow Q). This first wall section 75 is provided opposite one end of the sheet 3 (virtually illustrated by a chain double-dashed line in FIG. 3). By means of coming into contact with the sheets 3, the first wall section 75 regulates the position of the sheets 3 in the sheet housing section 90. A pair of sidewalls 72, 72 are provided along side sections of the first tray 70 in the widthwise direction of the sheet (the direction of a Z axis). The bottom plate 16 is provided beneath the sheets 3 in the first tray 70 so as to receive the sheets 3 housed in the sheet housing section 90.

Figure 4:
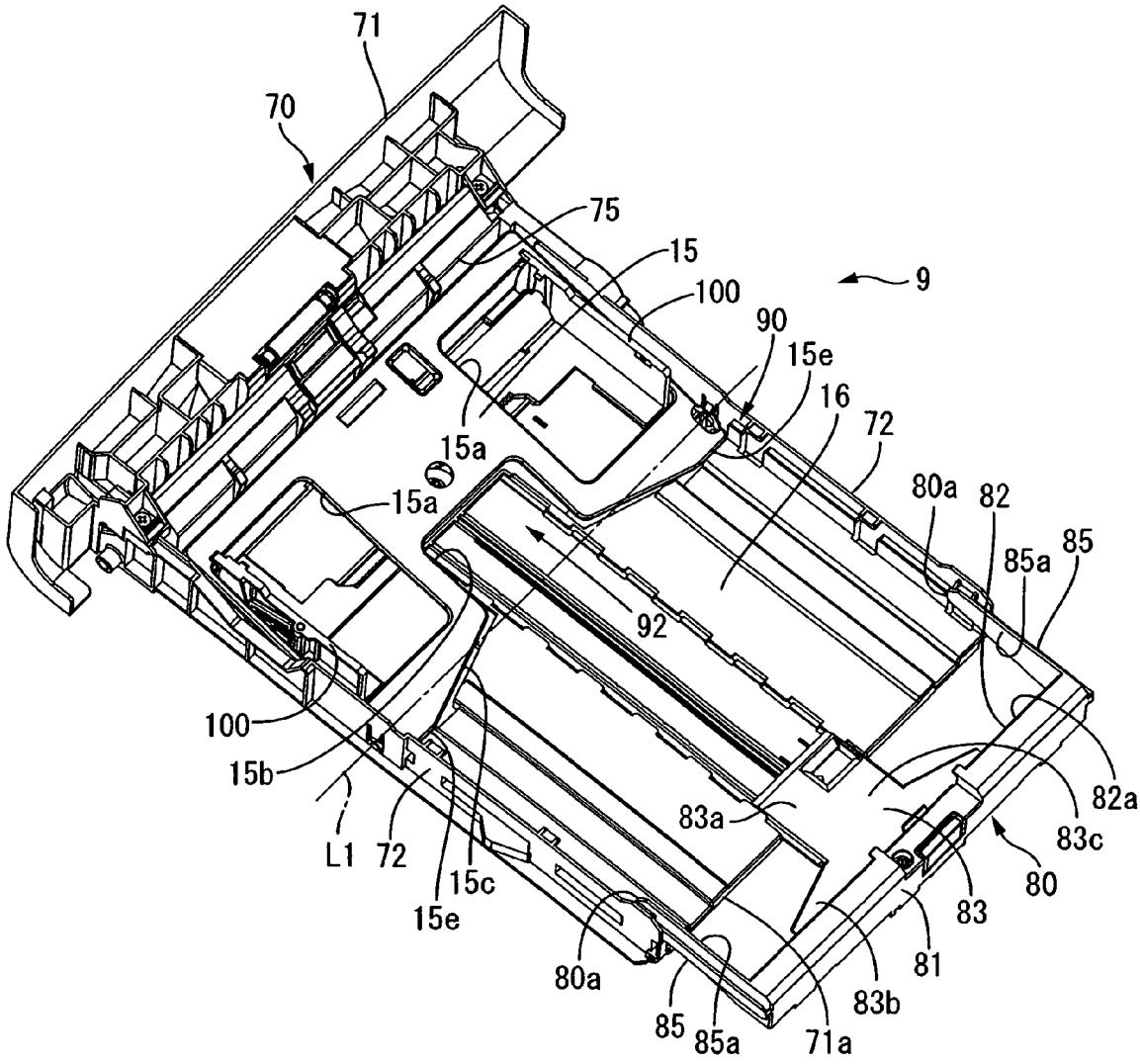
FIG. 4 is a perspective view corresponding to FIG. 3.

The second tray 80 is configured to be able to move with respect to the first tray 70, and has a second wall section 82 disposed on the upstream end portion of the sheet housing section 90 in the sheet-feeding direction Q. By means of coming into contact with the sheets 3, the second wall section 82 relates the position of the sheets 3 in the sheet housing section 90. As shown in FIG. 4, the sheet housing section 90 is formed into a box shape whose upper portion is open, from the first wall section 75, the sidewalls 72, 72, and the bottom plate 16, all of which belong to the first tray 70, as well as from the second wall section 82 belonging to the second tray 80. As a result of the second tray 80 moving relative to the first tray 70, the interval between the first wall section 75 and the second wall section 82 is changed, which in turn changes the size of the sheet housing section 90.

In the first tray 70, a first tray main body 71 is formed from the first wall section 75, the sidewalls 72, 72, and the bottom plate 16, all of which have been described previously. The sheet-urging plate 15 is fixed to the first tray main body 71 in a pivotable manner. The sheet-urging plate 15 is configured to press, against the above-described sheet-feeding roller 12 (FIG. 1), at least a downstream end portion of the sheet 3.

The second tray 80 is provided with a second tray main body 81 having the second wall section 82, as well as with a first coupling section 83 and a second coupling section 85 for coupling the second tray main body 81 to the first tray main body 71. As shown in FIGS. 3 and 4, the second tray 80 is made movable such that a wall surface 82*a*, which contacts the sheets, of the second wall section 82 comes to a position upstream of an upstream end portion 71*a* of the first tray main body 71.

Figure 5:
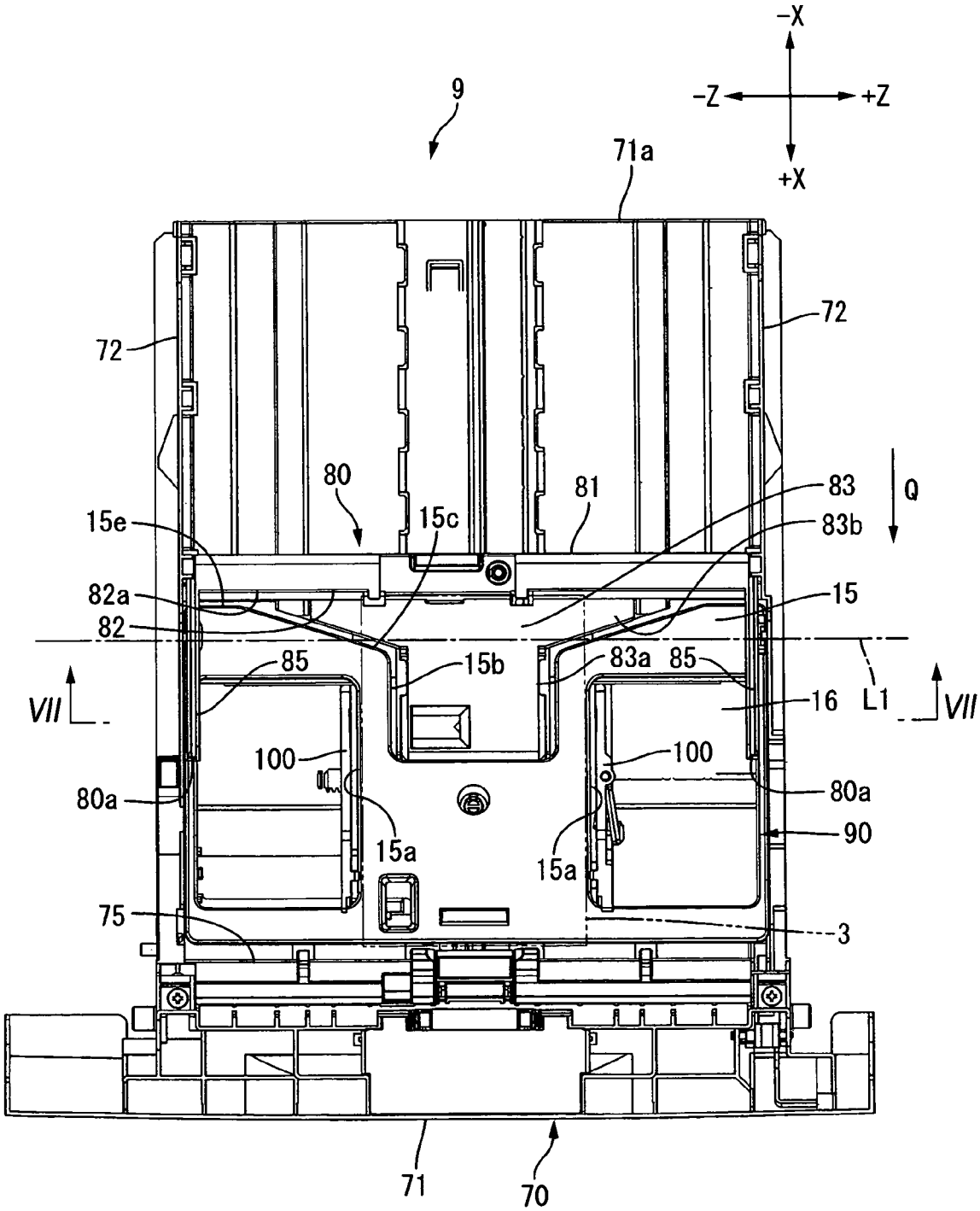
FIG. 5 is a plan view illustrating a size-enlarged state of the sheet-feeding cassette.

In addition to the wall surface being made movable as mentioned above, the second tray 80 is made movable in relation to the first tray 70 such that a downstream end portion 80*a* of the second tray 80 comes to a position downstream of an upstream end portion 15*e* of the sheet-urging plate 15, as shown in FIG. 5.

By means of the configuration of the present aspect, the wall surface 82*a*, which contacts the sheets 3, of the second wall section 82 is made movable so as to come to a position upstream of the upstream end portion 71*a* of the first tray main body 71. Accordingly, as shown in FIG. 3, sheets, which are so large as to extend beyond the first tray 70, can be housed in the sheet housing section 90. Moreover, since a pivotal axis L1 of the sheet-urging plate 15 is fastened to the first tray main body 71, a positional relationship between the sheet-urging plate 15 and the first wall section 75 is determined, and a downstream end portion of sheets guided by the first wall section 75 can be stably pressed.

As shown in FIG. 5, the downstream end portion 80*a* of the second tray 80 is made movable to a position downstream of the upstream end portion 15*e* of the sheet-urging plate 15. Therefore, the second tray 80 can be placed at a further downstream position with reference to the sheet-feeding direction Q. Consequently, the interval between the first wall section 75 and the second wall section 82 can be set to a smaller value, and the sheet-feeding cassette can cope with sheets of smaller sizes as shown in FIG. 5.

The first tray 70 is also provided with a pair of side guides 100 which oppose the edges of the sheet 3 in the widthwise direction thereof and are provided so as to be movable in a direction (in the present aspect, a direction orthogonal to a moving direction of the second tray 80; i.e., the direction of the Z axis) crossing the moving direction of the second tray 80 (the direction of the X axis). As shown in FIG. 5, the second tray 80 is made movable such that the downstream end portion 80*a* of the second tray in the sheet-feeding direction comes to a position downstream of the upstream end portions of the side guides 100. As a result, the edges of various sheets of different widths in the widthwise direction thereof can be stably supported, and the second tray 80 can be moved to a further downstream position with reference to the sheet-feeding direction Q. Therefore, the sheet-feeding cassette can more easily cope with sheets of smaller sizes.

The second tray 80 is provided with a first coupling section 83 to be coupled with the bottom plate 16 of the first tray main body 71, and two second coupling sections 85, 85 to be coupled with the pair of sidewalls 72, 72 provided on the first tray main body 71. By virtue of presence of the first coupling section 83 and the second coupling sections 85, 85, the second tray 80 is coupled to the bottom plate 16 and the sidewalls 72, 72 of the first tray main body 71, to thus achieve tighter coupling. More specifically, the second coupling sections 85, 85 are configured so as to be supported and guided by grooves formed in the sidewalls 72, 72.

As shown in FIG. 3, the first coupling section 83 is configured to extend downstream from the second wall section 82 with respect to the sheet-feeding direction. An engaging section 83*a* to engage with the bottom plate 16 of the first tray main body 71 is provided on a lower end portion of the first coupling section 83 in the extending direction thereof. A reinforcement section 83*b*, which is wider than the engaging section 83*a*, is provided on an upstream end portion of the first coupling section 83 integrally with the second wall section 82. By means of this configuration, the first coupling section 83 and the bottom plate 16 can be coupled together, and the strength of the first coupling section 83 is also enhanced. As shown in FIGS. 3 and 4, the first coupling section 83 has an upper surface 83*c* in a maximum enlargement position where the interval between the first wall section 75 and the second wall section 82 becomes maximum, wherein the upper surface 83*c* supports an area of the sheets 3 from below.

Figure 6:
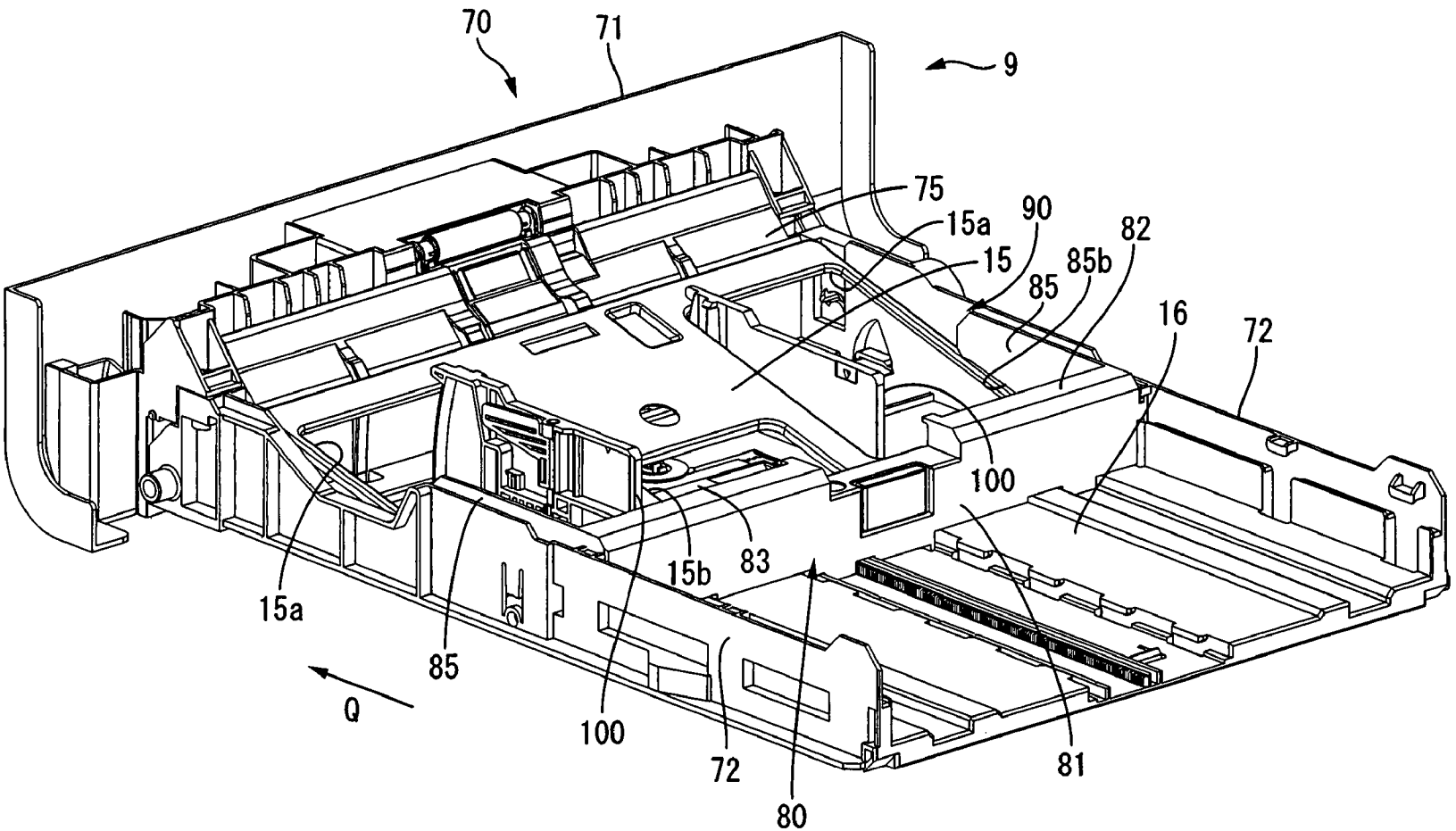
FIG. 6 is a perspective view corresponding to FIG. 5.

A recess section 92 is formed in an upstream end portion of the sheet-urging plate 15, which is provided on the first tray 70. As shown in FIGS. 5 and 6, the first coupling section 83 can be housed in the recess section 92. Specifically, there has been conceived a contrivance that enables stable coupling by means of the first coupling section 83 and the second coupling section 85, as well as preventing the first coupling section 83 extending downstream from the second wall section 82 from interfering with the sheet-urging plate 15 even when the second wall section 82 remains close to the sheet-urging plate 15.

The recess section 92 of the sheet-urging plate 15 has an end-section housing section 15*b* which houses a portion of the downstream end portion of the first coupling section 83 (i.e., the engaging section 83*a*), and a reinforcement-section housing section 15*c* which is formed so as to become wider than the end-section housing section at an upstream side of the end-section housing section 15*b* in the sheet-feeding direction. The end-section housing section 15*b* and the reinforcement-section housing section 15*c* are made in the form of cutouts in the end portion of the sheet-urging plate 15.

As mentioned above, the second coupling sections 85 are provided in a number of two. The respective second coupling sections 85 have sidewall surfaces 85*a*, 85*a* opposing the side edges of the sheets 3 in the maximum enlargement position such as that shown in FIG. 3. In such a maximum enlargement position, the upstream end portion of the sheet 3 is guided by means of the wall surface 82*a* of the second wall section 82, the upper surface 83*c* of the first coupling section 83, and the sidewall surfaces 85*a*, 85*a* of the respective second coupling sections 85.

As mentioned previously, the first tray 70 is provided with the side guides 100 opposing the edges of the sheets 3 in the widthwise direction thereof. However, as shown in FIG. 5, the second coupling sections 85, 85 can be housed between the sidewalls 72, 72 of the first tray main body 71 and the side guides 100, 100 with respect to the widthwise direction of the sheet. Specifically, each of the second coupling sections 85 is moved downstream by utilization of a clearance between the corresponding side guide 100 and sidewall 72. By means of this configuration, various sheets of different widths can be housed in a compact manner without causing the second coupling sections 85 to interfere with the side guides 100 while side edges of the sheets can be supported by the side guides 100. Consequently, the sheet-feeding cassette can more appropriately cope with sheets of smaller sizes.

As shown in FIG. 3, the side guide 100 is configured such that outward movement of the second coupling section 85 in the widthwise direction thereof is regulated at the center rather than at the housing position where the second coupling section 85 is housed in the space between the sidewall 72 of the first tray main body 71 and the side guide 100. Put another way, movement of the second coupling section 85 is regulated by a clearance C which enables movement of the same. As a result, the side guide 100 tends not to hinder housing of the second coupling sections 85, and hence the second housing section 85 is smoothly housed in the space between the side guide 100 and the sidewall, and by extension, smooth movement of the second tray 80 becomes feasible.

Figure 7:
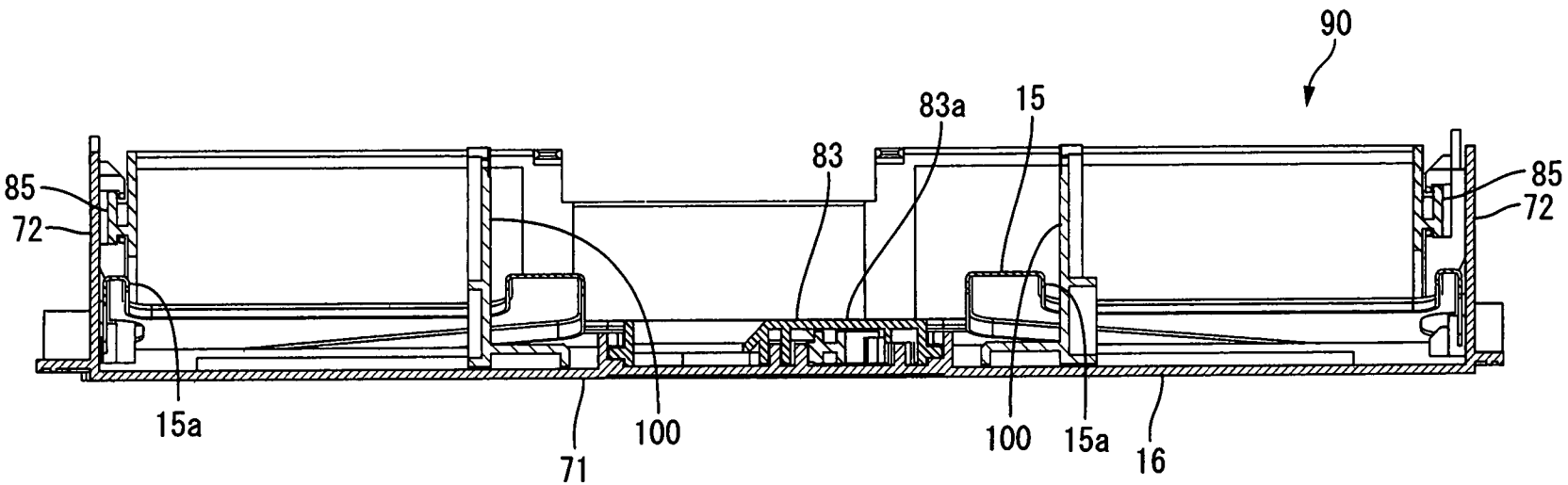
FIG. 7 is a cross-sectional view taken along VII-VII shown in FIG. 5.
Figure 8:
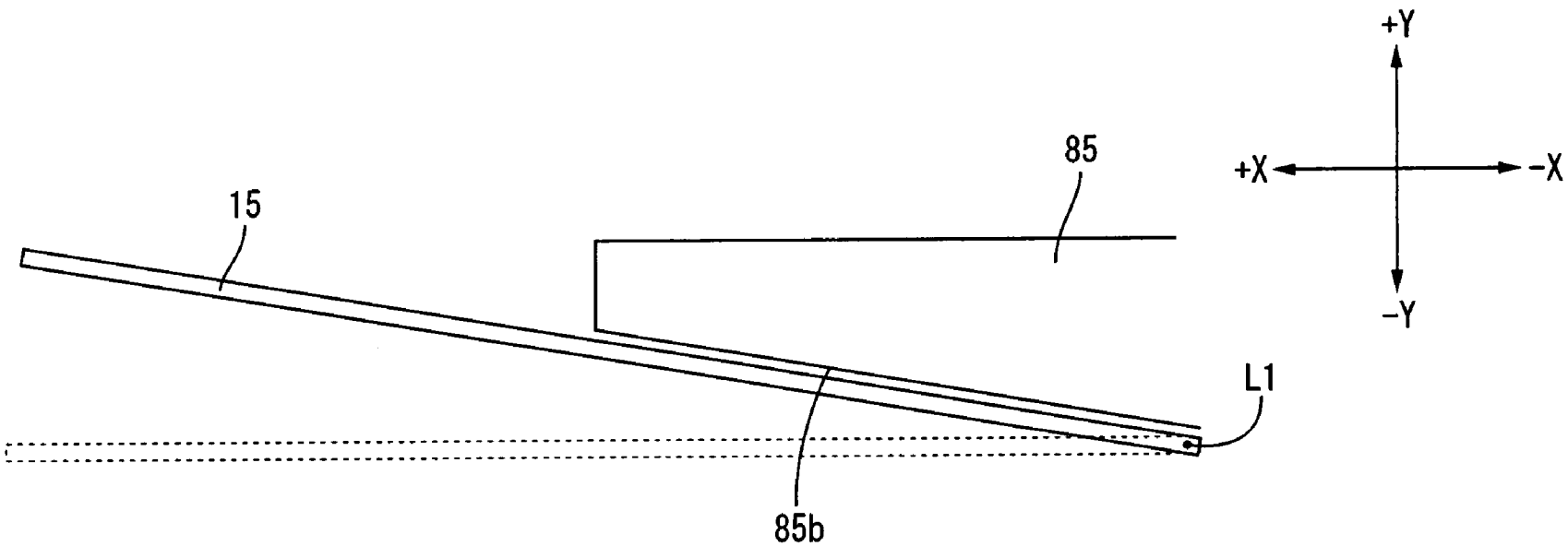
FIG. 8 is a descriptive view for describing a relationship between a sheet-urging plate and a second coupling section.

As shown in FIGS. 6 and 7, the second coupling section 85 can be placed in a position above the sheet-urging plate 15 at a location downstream of the pivotal axis L1 of the sheet-urging plate 15 in the sheet-feeding direction Q [in other words, a position where +Y is achieved in the direction of the Y axis (the heightwise direction of the image forming apparatus)]. As conceptually shown in FIG. 8, the sheet-urging plate 15 is displaceable between a first position indicated by a broken line (a position where the upper surface of the sheet-urging plate 15 becomes essentially parallel to the bottom plate 16) and a maximum pivotal position indicated by a solid line. As shown in FIGS. 6 and 8, a slope section 85*b* is provided on a lower end portion of each of the second coupling sections 85, wherein the angle between the second tray 80 and the bottom plate 16 becomes identical with the maximum pivotal angle between the sheet-urging plate 15 and the bottom plate 16. By virtue of the above configuration, there can be readily realized a configuration which enables positioning of the second coupling section 85 in a location downstream of the sheet-urging plate 15 with respect to the sheet-feeding direction and which makes pivotal motion of the sheet-urging plate 15 unlikely to interfere with the second coupling section. Here, the same angle is adopted, but there may be adopted a configuration such that the angle between the slope section 85*b* and the bottom plate 16 becomes greater than the maximum pivotal angle between the sheet-urging plate 15 and the bottom plate 16.

The present invention is not limited to the aspect having been explained by reference to the above descriptions and drawings. For instance, the following aspect is also included within the scope of the invention. In addition, other than those described hereinbelow, the invention may be implemented while applying various modifications without departing from the scope of the invention.

In the above aspect, there has been described an example where the wall surface of the second wall section is located at a position upstream of the end portion of the sheet-urging plate when the distance between the first wall section and the second wall section is set to a minimum value. However, the wall surface of the second wall section may be made movable in a location downstream of the end portion of the sheet-urging plate. By means of this configuration, sheets of smaller sizes can be coped with, while the sheet-urging plate is formed larger.

What is claimed is:

1. An image forming apparatus comprising:

a main body casing;

a sheet-feeding member; and a sheet-feeding cassette that is removably attached to the main body casing and has a sheet housing section for housing a plurality of sheets;

wherein the sheet-feeding cassette comprises:

a first tray located on a downstream end portion of the sheet housing section in a sheet-feeding direction, the first tray including a first tray main body having a first wall section that regulates a position of the sheet in the sheet housing section by coming into contact with the sheet, and a sheet-urging plate being pivotably attached to the first tray main body and capable of urging a downstream end portion of the sheet against the sheet-feeding member; and a second tray located at an upstream end portion of the sheet housing section in the sheet-feeding direction, the second tray including a second tray main body having a second wall section that is located on an upstream end portion of the second tray in the sheet-feeding direction and regulates the position of the sheet in the sheet housing section by coming into contact with the sheet, the second tray being coupled to the first tray in a movable manner whereby an interval between the first wall section and the second wall section is made changeable;

wherein a wall surface of the second wall section, which comes into contact with the sheet, moves to a position upstream of an upstream end portion of the first tray main body that is more upstream than any other portion of the first tray main body;

a downstream end portion of the second tray in the sheet-feeding direction moves to a position downstream of an upstream end portion of the sheet-urging plate that is more upstream than any other portion of the sheet-urging plate in the sheet-feeding direction; and a size of the first tray and a size of the second tray are fixed.

2. The image forming apparatus according to claim 1, wherein the first tray comprises a side guide that opposes an edge of the sheet in a widthwise direction thereof, the side guide being movable in a direction crossing a moving direction of the second tray; and the downstream end portion of the second tray in the sheet-feeding direction is movable to a position downstream of an upstream end portion of the side guide in the sheet-feeding direction.

3. The image forming apparatus according to claim 1, wherein the second tray comprises:

a first coupling section to be coupled with a bottom plate, which receives the sheet, of the first tray main body; and second coupling sections to be coupled with sidewalls which are disposed on respective sides of the first tray main body in a widthwise direction of the sheet.

4. The image forming apparatus according to claim 3, wherein the second coupling sections are provided in a number of two; and the second coupling sections are respectively coupled with the sidewalls of the first tray main.

5. The image forming apparatus according to claim 3, wherein a recess is formed in the upstream end portion of the sheet-urging plate in the sheet-feeding direction, the recess housing the first coupling section.

6. The image forming apparatus according to claim 3, wherein the first coupling section is configured to extend downstream from the second wall section in the sheet-feeding direction; and the first coupling section has at a downstream end portion in an extending direction thereof an engaging section to be engaged with the bottom plate of the first tray main body, and a reinforcement section, which is wider than the engaging section, integrally formed with the second wall.

7. The image forming apparatus according to claim 6, wherein the recess of the sheet-urging plate has an end-section housing section for housing the downstream end portion of the first coupling section in the sheet-feeding direction, and a reinforcement-section housing section which is formed to be wider than the end-section housing section at an upstream side of the end-section housing section.

8. The image forming apparatus according to claim 3, wherein the first tray comprises a side guide that opposes an edge of the sheet in a widthwise direction thereof, the side guide being movable in a direction crossing a moving direction of the second tray; and the second coupling section is movable to a space between the sidewall of the first tray main body and the side guide.

9. The image forming apparatus according to claim 8, wherein outward movement of the side guide is regulated in the widthwise direction of the sheet at a center side of the space in the widthwise direction.

10. The image forming apparatus according to claim 3, wherein the second coupling section is movable to a position above the sheet-urging plate, on a downstream side of a pivotal axis of the sheet-urging plate in the sheet-feeding direction; and the second coupling section has, at a lower end portion of the second coupling section, a slope section whose angle with respect to the bottom plate of the first tray main body is greater than or equal to a maximum pivotal angle of the sheet-urging plate with respect to the bottom plate.

11. The image forming apparatus according to claim 3, wherein the first coupling section has, at a maximum enlargement position where an interval between the first wall and the second wall becomes maximum, an upper surface for supporting an area of the sheet from below;

the second coupling sections are provided in a number of two, and respectively have sidewall surfaces opposing side edges of the sheets in the maximum enlargement position; and an upstream end portion of the sheet in the sheet-feeding direction is guided by the wall surface of the second wall section, the upper surface of the first coupling section, and the sidewall surfaces of the respective second coupling sections.

12. A sheet-feeding cassette having a sheet housing section for housing a plurality of sheets, comprising:

a first tray located on a downstream end portion of the sheet housing section in a sheet-feeding direction, the first tray including a first tray main body having a first wall section that regulates a position of the sheet in the sheet housing section by coming into contact with the sheet, and a sheet-urging plate being pivotably attached to the first tray main body and capable of urging a downstream end portion of the sheet against a sheet-feeding member; and a second tray located at an upstream end portion of the sheet housing section in the sheet-feeding direction, the second tray including a second tray main body having a second wall section that is located on an upstream end portion of the second tray in the sheet-feeding direction and regulates the position of the sheet in the sheet housing section by coming into contact with the sheet, the second tray being coupled to the first tray in a movable manner whereby an interval between the first wall section and the second wall section is made changeable;

wherein a wall surface of the second wall section, which comes into contact with the sheet, moves to a position upstream of an upstream end portion of the first tray main body that is more upstream than any other portion of the first tray main body;

a downstream end portion of the second tray in the sheet-feeding direction moves to a position downstream of an upstream end portion of the sheet-urging plate that is more upstream than any other portion of the sheet-urging plate in the sheet-feeding direction; and a size of the first tray and a size of the second tray are fixed.

13. The sheet-feeding cassette according to claim 12, wherein the second tray comprises:

a first coupling section to be coupled with a bottom plate, which receives the sheet, of the first tray main body; and second coupling sections to be coupled with sidewalls which are disposed on respective sides of the first tray main body in a widthwise direction of the sheet.

14. The sheet-feeding cassette according to claim 13, wherein the first tray comprises a side guide that opposes an edge of the sheet in a widthwise direction thereof, the side guide being movable in a direction crossing a moving direction of the second tray; and the second coupling section is movable to a space between the sidewall of the first tray main body and the side guide.

15. The sheet-feeding cassette according to claim 14, wherein outward movement of the side guide is regulated in the widthwise direction of the sheet at a center side of the space in the widthwise direction.

16. The sheet-feeding cassette according to claim 13, wherein the second coupling section is movable to a position above the sheet-urging plate, on a downstream side of a pivotal axis of the sheet-urging plate in the sheet-feeding direction; and the second coupling section has, at a lower end portion of the second coupling section, a slope section whose angle with respect to the bottom plate of the first tray main body is greater than or equal to a maximum pivotal angle of the sheet-urging plate with respect to the bottom plate.

* * * * *